United States Patent [19]

Kim

[11] 4,224,746

[45] Sep. 30, 1980

[54] SHOE VENTILATING INSOLE

[76] Inventor: Sunyong P. Kim, 535 N. Cahuenga Blvd., Los Angeles, Calif. 90004

[21] Appl. No.: 8,278

[22] Filed: Feb. 1, 1979

[51] Int. Cl.[2] ..... A43B 7/06; A43B 13/40

[52] U.S. Cl. ..... 36/3 B; 36/44

[58] Field of Search ..... 36/3 B, 3 R, 44, 43; 128/594

[56] References Cited

U.S. PATENT DOCUMENTS

| | | | |
|---|---|---|---|
| 1,697,589 | 1/1929 | Cort | 36/44 X |
| 2,673,171 | 3/1954 | Bellavoine | 36/3 B |
| 2,797,501 | 7/1957 | Brahm | 36/3 B |
| 3,315,379 | 4/1967 | Estandian | 36/3 R |

FOREIGN PATENT DOCUMENTS

| | | | |
|---|---|---|---|
| 585509 | 11/1958 | Italy | 36/3 B |
| 307862 | 3/1929 | United Kingdom | 36/3 R |

*Primary Examiner*—James Kee Chi

*Attorney, Agent, or Firm*—John T. Matlago

[57] ABSTRACT

A cushioned insole for a shoe comprises a member formed of a resilient, porous material enclosed in an impervious envelope having a plurality of air inlet ports near the rear edge of its heel portion and a plurality of air outlet ports in its ball portion in the region of the toes of the wearer of the shoe. Such a construction, in addition to cushioning the foot, provides for drawing cool air into the toe region of the shoe as a result of the normal walking action.

1 Claim, 8 Drawing Figures

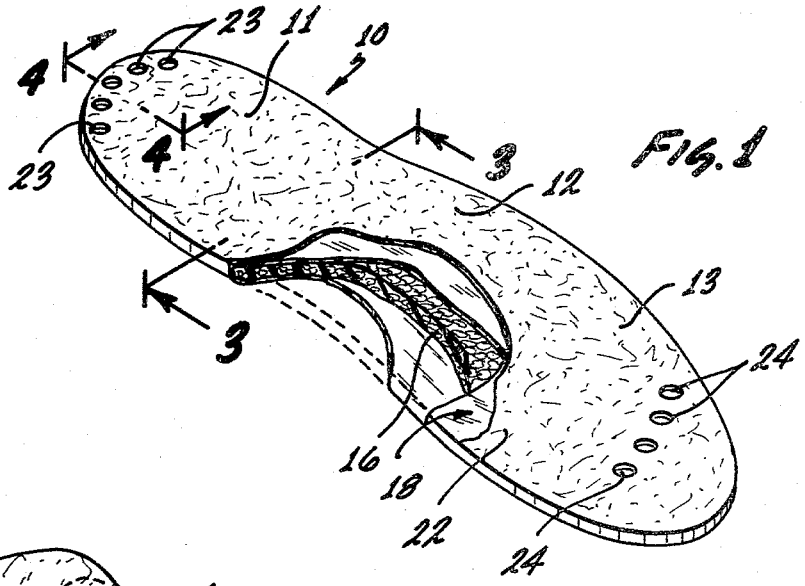
FIG. 1
FIG. 2
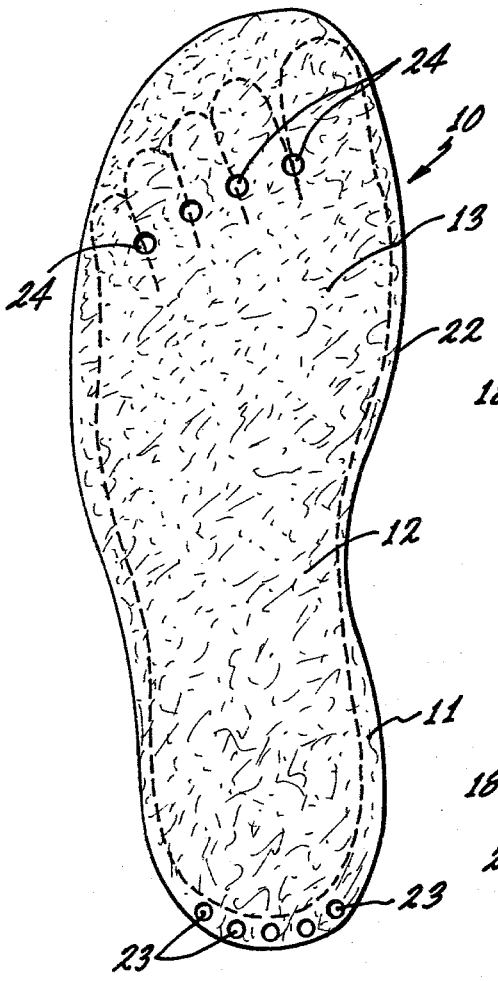
FIG. 3
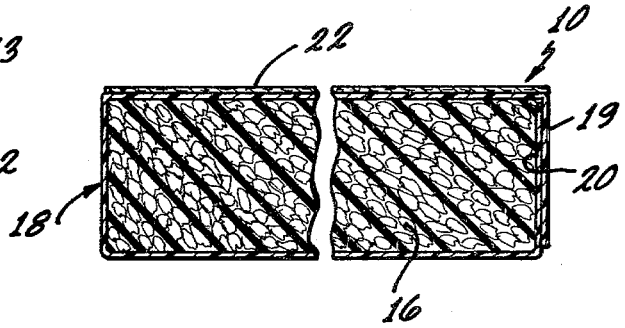
FIG. 4
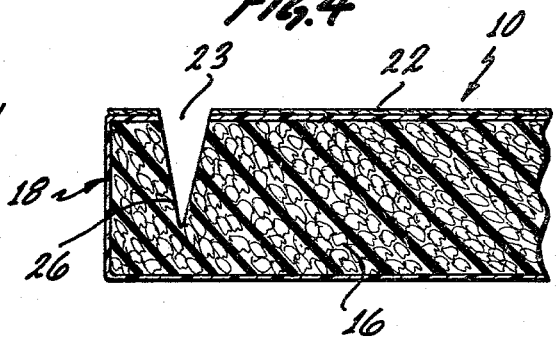

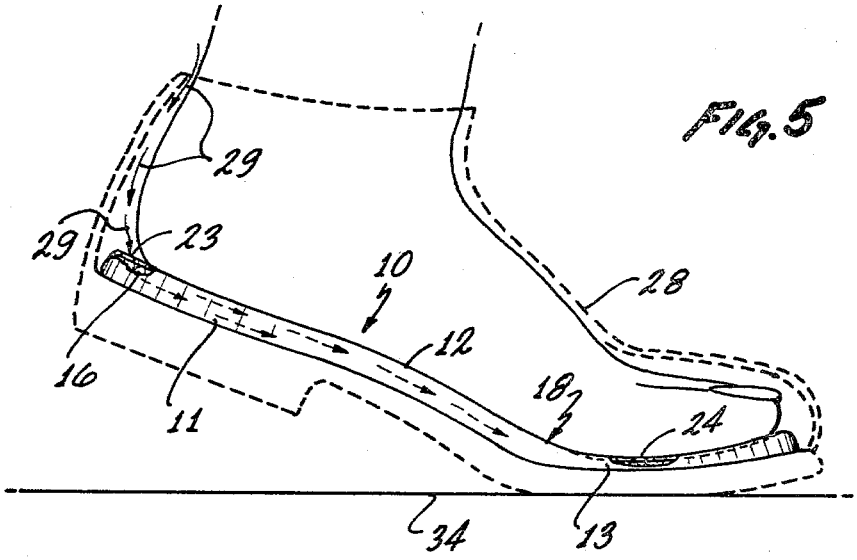
FIG. 5
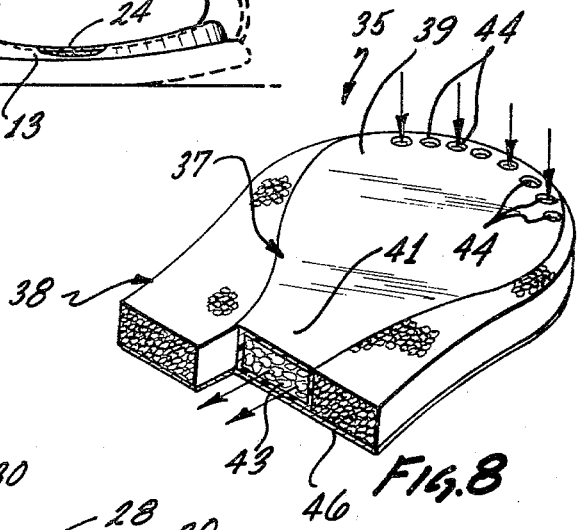
FIG. 8
FIG. 6
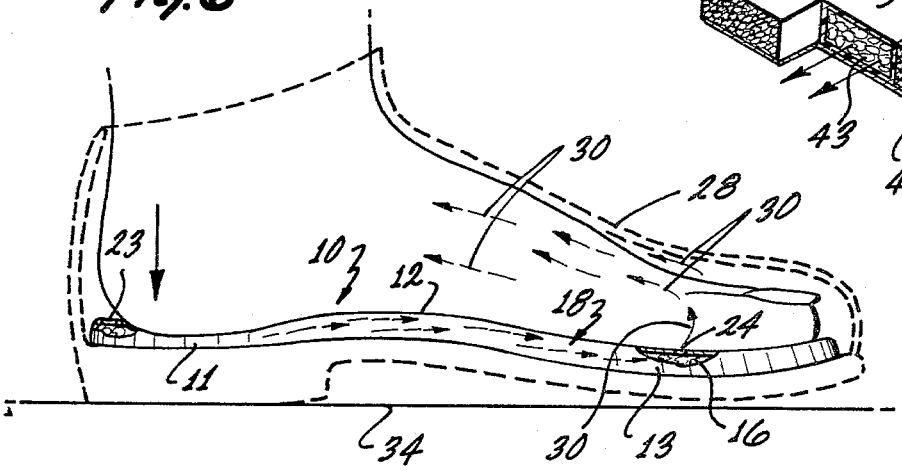
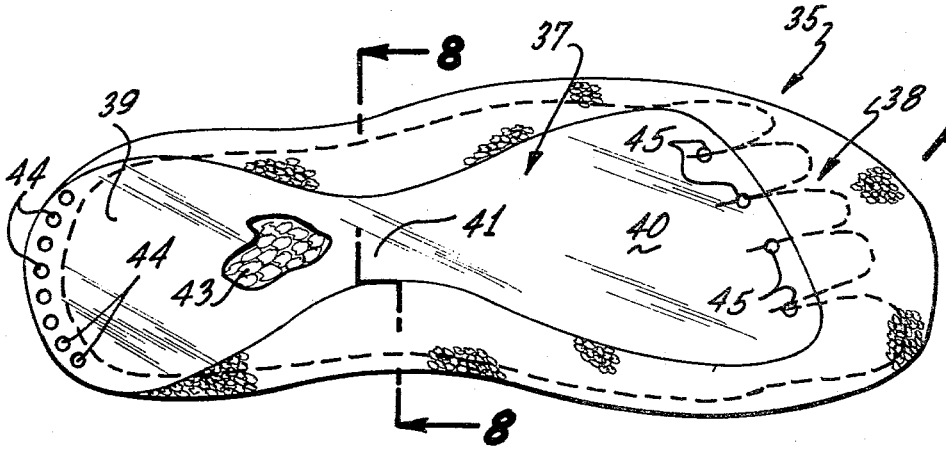
FIG. 7

SHOE VENTILATING INSOLE

BACKGROUND AND SUMMARY OF THE INVENTION

This invention relates to insoles for shoes and more particularly to an improved cushioning insole structured to provide for ventilating the toes of the foot.

When people do a lot of walking, especially in the warmer and more humid climates, their feet perspire causing discomfort primarily in the vicinity of the regions between the toes. Inasmuch as it is common practice to provide a cushioning insole in a shoe, it is highly desirable to adapt such an insole to provide for pumping ventilating air into the interior of the shoe as a result of the normal walking action.

In accordance with the present invention, a cushioning insole for a shoe comprises a member formed of a resilient, porous material enclosed in an impervious envelope. The envelope has a plurality of air inlet ports near the rear edge of its heel portion and a plurality of air outlet ports in its ball portion. As a result of the normal walking action, the resilient member operates to draw air into the envelope by way of the inlet ports and to discharge air from the envelope by way of the outlet ports into the region of the toes of the wearer.

One of the objects of the present invention is to provide an insole for a shoe which is especially structured to effectively introduce cool air into the regions between the toes of the wearer as a result of the normal walking action.

Yet another object of the present invention is to provide an insole for a shoe which utilizes the differential pressure within an impervious envelope as created by a resilient member therein to fill the envelope with cool air and to control the flow of the air toward the ball portion of the insole for discharge in the regions between the toes of the wearer.

With these and other objects in view, the invention consists of the construction, arrangement and combination of the various parts of the device, whereby the objects contemplated are attained as hereinafter set forth, pointed out in the appended claims and illustrated in the accompanying drawings.

BRIEF DESCRIPTION OF DRAWINGS

FIG. 1 is a perspective view, partly in section, of a shoe insole embodying the present invention;

FIG. 2 is a plan view of the shoe insole of the present invention showing the relationship of the foot when positioned thereover;

FIG. 3 is a sectional view of the shoe insole taken along line 3—3 of FIG. 1;

FIG. 4 is a sectional view of the shoe insole taken along line 4—4 of FIG. 1;

FIG. 5 is a view of the foot and the insole within a shoe with the weight on the ball of the foot;

FIG. 6 is a view of the foot and the insole within a shoe with the weight on the heel of the foot;

FIG. 7 shows a plan view of a modified embodiment of the shoe insole of the present invention; and FIG. 8 is a perspective view of the heel portion of the modified embodiment of the insole taken along line 8—8 of FIG. 7.

DETAILED DESCRIPTION OF INVENTION

Referring to the drawings, a shoe insole 10 in accordance with the present invention is shown in FIG. 1 to include a heel portion 11, an arch portion 12 and a ball portion 13. The shoe insole 10 includes a resilient member 16 made of a sponge-like or rubber material and generally conforming in shape with the sole of a shoe. The member 16 is enclosed in a chamber or envelope 18 that may be formed by wrapping a thin sheet of vinyl thereabout and gluing the overlapping sides 19 and 20 together (FIG. 3). A cotton liner 22 may be attached by adhesive to the upper surface of the envelope 18. A series of on the order of five inlet ports 23 are provided on the top of the envelope 18 just inwardly from the heel end thereof. A series of preferably four air outlet ports 24 are provided on the top of the envelope 18 at locations corresponding to the respective regions between the toes of the wearer of a shoe with the insole 10, as illustrated in FIG. 2. It should be particularly noted that the inlet ports 23 and the outlet ports 24 are the only openings provided in the envelope 18, the remainder of the surface including the top and bottom and peripheral sides thereof all being impervious to air.

It should now be clear that the resilient member 16 is made of a material which is quite porous such that when it is not compressed, i.e., when it is of its normal free standing size within the envelope 18, as shown in FIG. 3, the small open spaces provided therein by the porous formation are filled with the ambient air.

As shown in FIG. 4, the air inlet ports 23 in the envelope 18 communicate with V shaped openings 26 which extend substantially through the thickness of the member 16 to facilitate the entering of air through the inlet ports 23 into the body of the heel portion 11 thereof when the member 16 expands to its normal size. The air outlet ports 24 may communicate with similar V shaped openings which extend substantially through the thickness of the member 16 to facilitate the discharge of air in the body of the ball portion 13 out the outlet ports 24 when the member 16 is compressed.

When a party wearing the shoe insole 10 places the ball of his foot onto the floor or pavement 34, during his normal walking action, as shown in FIG. 5, the heel of his foot naturally flexes upwardly as he continues to move forward. This causes the heel of the shoe to slightly drop away from the foot and allows the heel portion 11 of the resilient member 12 to expand within the envelope 18 and creates a negative pressure differential therein which results in cool air being drawn into the gap provided between the back of the shoe 28 and the rear of the foot, as indicated by the arrows 29, and through inlet ports 23 into the envelope 18.

Thereafter, when the person lifts his foot and moves it forwardly, he initially bears down on the pavement 34 and compresses the rear end of the heel portion 11, as illustrated in FIG. 6, thus sealing off the inlet ports 23. As the person continues to move forward he shifts his weight so as to bear down on more of the heel portion 11 of the member 12, thereby compressing and reducing the open space and creating a positive pressure differential within the envelope 18. Inasmuch as the only openings now left in the envelope 18 are the outlet ports 24, the cool air in envelope 18 is discharged through these outlet ports 24 into the regions between the toes and on through the gaps left between the sides and upper parts of the foot, as indicated by the arrows 30. As a result of the cool air being pumped through the shoe, in this fashion, with every step of the wearer, the shoe, stocking and foot of the wearer are maintained dry from perspiration.

It should be clearly understood that the member 16 is resilient so that it not only compresses and cushions the foot of the person upon contacting the pavement 34, but also so that upon flexing the shoe as the heel portion of the foot is lifted from the pavement, the member 16 is able to expand to its normal size within the envelope 18 to thereby draw air therein through the inlet ports 23. The member 16 is made sufficiently longitudinally porous so as to permit the differential pressure within the envelope 18 to be transferred toward the ball portion 13 upon the heel portion 11 thereof being compressed as the person shifts his weight on moving forward. It should be noted that the insole 10 of the present invention may necessarily have to be made thicker then the typical cushioning insole to provide the necessary open space needed therein to hold and thereby transfer the desired volume of cooling air.

It should be particularly noted that the inlet ports 23 are especially located close to the rear edge of the envelope 18 so that these ports will never be covered by the heel of the wearer of the shoes. This assures that air is made available to enter the envelope 18 at all times when the member 16 is not compressed and especially when the envelope 18 has a negative pressure differential created therein upon member 16 expanding to its normal size.

It should be appreciated that although only a small volume of cool air is caused to be moved, i.e. flow, in this fashion through the member 16 and between the toes of the wearer, as he takes each step, inasmuch as the cool air is discharged at the points to do the most good, the ventilating is very effective.

Reference will next be made to FIGS. 7 and 8 which show a modified embodiment of a shoe insole 35 in accordance with the present invention. This embodiment comprises an assembly including a centralized air transfer envelope 37 and a peripheral cushioning support member 38. The envelope 37 which is formed of an air impervious material has a heel portion 39 and a ball portion 40 interconnected by a passageway 41. Enclosed within envelope 37 is a correspondingly shaped resilent member 43 formed of a material having a porous formation similar to the member 16 in FIG. 1. In this embodiment, the areas of the heel portion 39 and the ball portion 40 of envelope 37 are each made smaller then the areas of corresponding portions of the typical insole of a shoe. The inner edge of the cushioning support member 38 is shaped to closely fit about the curved longitudinal sides and the front end of the envelope 37 so as to form a continuation thereof and so as to provide an outer contour for the insole 35 which corresponds to that of the sole of a shoe.

A series of on the order of seven inlet ports 44 are provided on the top of the rear end of the heel portion 39 of air transfer envelope 37 and a series of four outlet ports 45 are provided on the top of the ball portion 40 of envelope 37 in the regions between the toes of the wearer, as illustrated in FIG. 7.

As shown in FIG. 8, the air transfer envelope 37 and the cushioning support member 38 may be separately fabricated. They can then be assembled together with the inner peripheral edge of the cushioning support member 38 fitted about the sides and front of the air transfer envelope 37 and bonded together by an adhesive to provide the overall shape corresponding to the sole of a shoe. A base 46 made of a thin sheet of vinyl having the shape of the insole may be bonded to the bottom of the assembly.

It should be noted that the heel portion 39 of the air transfer envelope 37 is of a size and location conforming to the major pressure area on the heel portion of the foot. This feature together with the narrow passageway 41 serves to more effectively route and direct the cool air drawn into the heel portion 39 by way of the inlet ports 44 into the ball portion 40 which latter is of a size and location generally conforming to the major pressure area of the ball of the foot. In other words, the heel and ball portions of the air transfer envelope 37 are especially shaped and located so as to help to directionally transfer, i.e., control the flow of the air from the heel portion 39 to the ball portion 40 and out the outlet ports 45 during the normal walking action.

It should be noted that the structure of the insole 35 enables the peripheral cushioning support member 38 to be made of a resilient material which is more solid than the material of the air transfer member 43 so as to provide support for the foot. On the other hand, the material of the air transfer member 43 can be made more porous, i.e., with more void space when in its free standing condition, so as to hold a larger volume of air to thereby maximize the quantity of the air pumped or transferred through the air transfer envelope 37 each time the wearer takes a step.

Thus, the construction of the shoe insole 35 provides for more effectively transferring or pumping the air drawn through the air inlet ports 44 into the reduced heel portion 39 and through the passageway 41 into the reduced ball portion 40 and out the four outlet ports 45 respectively located in the regions between the toes of the wearer.

While in order to comply with the statutes the invention has been described in language more or less specific as to structural features, it is to be understood that the invention is not limited thereto but that the means and construction herein disclosed comprise the preferred forms of putting the invention into effect, and the invention is therefore claimed in any of its forms or modifications within the legitimate and valid scope of the appended claims.

What is claimed is:

1. A shoe ventilating insole assembly comprising:

a ventilating air transfer envelope formed of an air impervious material, said envelope including a heel portion and a ball portion connected by a narrow passageway portion;

each said portion having a plane areal size smaller then the corresponding portion of the inner sole of a typical shoe;

said air transfer envelope having a plurality of air inlet ports near the rear of the heel portion thereof and having a plurality of air outlet ports near the front of the ball portion thereof;

a filler member formed of a resilient highly porous material enclosed in said transfer envelope; and a peripheral cushioning support member formed of a resilient material which is substantially more solid then said filler material;

said peripheral cushioning support member closely fitted about and adhesively bonded to the curved longitudinal sides and the front end of said envelope so as to form a continuation of the plane areal surface thereof to provide an insole assembly having an overall outer contour corresponding to the inner sole of a typical shoe.

* * * * *